United States Patent [19]

Wilson

[11] Patent Number: 4,681,625

[45] Date of Patent: Jul. 21, 1987

[54] METHODS FOR SIMULTANEOUSLY DESULFURIZING AND DEGASSING STEELS

[76] Inventor: William G. Wilson, 820 Harden Dr., Pittsburgh, Pa. 15229

[21] Appl. No.: 800,544

[22] Filed: Nov. 21, 1985

Related U.S. Application Data

[63] Continuation-in-part of Ser. No. 203,315, Nov. 3, 1980, Pat. No. 4,570,692.

[51] Int. Cl.[4] ..... C21C 7/02

[52] U.S. Cl. ..... 75/53; 75/58

[58] Field of Search ..... 75/53, 58

[56] References Cited

U.S. PATENT DOCUMENTS 3,980,469 9/1976 Forster ..... 75/53

3,998,625 12/1976 Koros ..... 75/53

*Primary Examiner*—Peter D. Rosenberg

*Attorney, Agent, or Firm*—Buell, Ziesenheim, Beck & Alstadt

[57] ABSTRACT

A method is provided for removing sulfur and hydrogen from steel by the steps of pouring a stream of steel, low in oxygen and free of slag into a vertical tube installed in a ladle which extends from the bottom of the ladle to the top of the ladle, providing a means to introduce a flow of inert gas into the bottom of the tube to provide a stirring action within the tube, adding a lime based slag with a large capacity to absorb sulfur into the tube; adding ferro-alloys and metals into the tube which are known to enhance desulfurization and are necessary to achieve the specified composition of the steel; utilizing the stream of inert gas introduced into the bottom of the tube as a means for hydrogen removal.

31 Claims, 12 Drawing Figures

Liquidus isotherms of slags containing a mixture of lime, alumina, and fluorspar.

The equilibrium sulfur partition ratio for sulfur in steel containing 0.03% Al and $CaO-Al_2O_3-SiO_2$ slags at 1600°C The sulfide capacities of liquid slags in the lime/alumina/fluorspar system at 1500 °C (9).

Desulphurization of 18-8 stainless steel in an induction furnace at 1600°C with high and low viscosity fluxes.

Argon requirement for hydrogen and nitrogen removal at 2912°F.

Effect of Sulfur on Rate of Nitrogen Pickup by Falling Droplets.

Relation between total phosphorus content in the oxide melts and oxygen potential at constant phosphorous potential.

METHODS FOR SIMULTANEOUSLY DESULFURIZING AND DEGASSING STEELS

This application is a continuation-in-part application of my copending application Ser. No. 06/203,315 filed Nov. 3, 1980, now U.S. Pat. No. 4,570,692.

This invention relates to methods for simultaneously degassing and desulfurizing steels whereby both the gas and sulfur contents of the steel can be reduced to low levels.

The optimum condition for the elimination of hydrogen from steel is to pass droplets of steel through a vacuum as is the case in ladle to ladle degassing and ladle to ingot degassing. When dealing with a pool of molten steel, optimum hydrogen removal is achieved when a stream of small bubbles of inert gas is passed through the molten steel since hydrogen removal by gas bubbling is accomplished by the diffusion of the hydrogen in the steel into the bubble because the pressure of hydrogen in the bubble of inert gas is less than the pressure of the hydrogen in the liquid steel. The greater the number of bubbles, the greater the surface area of the bubbles for the same gas flow rate. Although passing large bubbles of inert gas through the molten pool of steel is the least effective method for hydrogen removal, this method has been shown to be capable of removing hydrogen to levels just slightly greater than 1 part per million (ppm). This is the hydrogen level that may be achieved by using a Dortmund-Hoerder (D-H) vacuum degasser and the like.

Desulfurization is optimized when a stream of small droplets is passed through a desulfurizing slag. It has been shown that the rate of sulfur removal obtainable when small droplets of metal are exposed to desulfurization is as much as ten times greater than when desulfurization is performed by stirring large ladles of steel to which desulfurizing slags have been added.

Any technology that removes sulfur, also, is effective in removing oxygen from steel. In addition, it has been demonstrated that when steels and high lime slags are stirred together there is a reduction in oxygen to very low levels. Therefore, any procedure which desulfurizes should be considered to be a method for oxygen removal as well.

It has been determined that phosphorus can be eliminated from steel when the oxygen content of the steel has been reduced to very low levels. With the low oxygen levels obtainable with the teachings of this invention combined with the use of lime based slags, the conditions necessary for phosphorus removal from steel may be achieved.

It is has been determined that steels with low sulfur and oxygen contents are particularly susceptible to absorbing any hydrogen and nitrogen to which they may be exposed. The sources of hydrogen include the water vapor in the air, the water absorbed by the lime in slags which have not been prefused, the water that is absorbed by the small amount of slag containing calcium carbide which is often associated with ferro-alloys and with the water occluded to the ferro-alloys and metals being added to the melts. Water may also be occluded to the desulfurizing slags as well as the water which may be absorbed by the lime. The amount of water occluded to any of these materials increases as their particle size becomes smaller because the surface area increases as the particle size decreases. Slags, ferro-alloys and metals that have been crushed to small sizes suitable for introduction into steel with injection technology would have large surface areas which would make them susceptible to having large quantities of occluded moisture.

Desulfurization is also enhanced when the amount of metal being desulfurized is minimized and the stirring is maximized. Desulfurization of large ladles full of steel is slower because desulfurization occurs mainly at the slag metal interface. In order for all of the steel in a ladle to come to the slag metal interface, long stirring times are required, and the stirring action is limited by the amount of freeboard in the ladle.

The slags capable of desulfurizing steel best are also those which are most erosive to ladle linings. In order to utilize these slags which desulfurize to lower sulfur contents at higher speeds, such slags must be prevented from coming in contact with the ladle linings at one specific place in the ladle lining such as the slag line on a ladle full of steel to which such slags are added with conventional desulfurizing practices. The long stirring times necessary to get all of the steel in the ladle in contact with the desulfurizing slags allow the slags to erode the ladle lining preferentially at the junction between the slag and metal.

The methods of this invention provide the optimum conditions for hydrogen removal from steel and rapid desulfurization to low levels using slags which are generally considered to be too erosive to ladle linings with conventional desulfurizing techniques.

I provide a method for removing hydrogen and sulfur from steel whereby a stream of steel low in oxygen and free of slag, is directed into a vertical tube in a ladle. The composition of the tube should be compatible with the steel being poured down the tube. The tube should be suspended from the top of the ladle and should extend from the bottom of the ladle to the top of the ladle and may even extend above the ladle. A means of supplying an inert gas to the bottom of the tube is also provided. The metal from which hydrogen and sulfur are to be removed is teemed into this tube. At the same time desulfurizing slags are added into the top of the tube and a flow of inert gas is provided at the bottom of the tube. Ferro-alloys and metals may be added into the tube along with the slag as a means of achieving the desired chemical composition of the steel as well as to enhance the ability of the slag to remove oxygen and sulfur. The desulfurization of the steel is conducted within the tube as a result of the stirring action provided by the stream of metal entering the tube as well as the stirring action of the gas rising from the bottom of the tube creating intimate contact between the slag, metals, ferro-alloys and the steel. Since the stirring energy is confined within the tube, the stirring energy is utilized by only a small portion of the steel at any given time providing very high intensity stirring which is known to accelerate the desulfurization reaction. The inside of the tube will achieve a coating of slag due to the vigorous stirring which prolongs its life in contact with the slag and steel being vigorously stirred just as the slag provides protection for a spoon used for obtaining molten metal samples from a furnace protects such a spoon. Refractory coatings have been developed that when applied to pipes used as oxygen lances prolong the life of the oxygen lance as compared to an uncoated lance. If the rate of solution of the tube was too fast, refractory coating similar to those used on oxygen lances could be applied to the tube to retard its rate of solution in the steel. The flow of inert gas from the bottom of the tube is also capable of removing hydrogen from the steel.

I further provide that the low oxygen level necessary to achieve desulfurization may be obtained by adding all of the ferro-alloys and metals necessary to attain the desired low oxygen contents and the slag into the tube inserted in the ladle as a stream of metal high in oxygen enters the tube.

I further provide that the ferro-alloys and metals being added down the tube with the slag to reduce the oxygen content to low levels will include all of the strong deoxidizers such as aluminum, calcium, rare earth metals, titanium, zirconium and the like and combinations of the same with other and metalloid metals such as iron, silicon and carbon which are generically referred to as ferro-alloys.

I further provide that the desired stream of steel which is low in oxygen and free of slag may be achieved by teeming the steel from the ladle into which the steel was poured from the furnace into a second ladle which is known as a double ladle practice. It is also possible to achieve a stream of steel low in oxygen and free of slag from a furnace equipped with eccentric tapping, bottom tapping or any other techniques known to those skilled in the art.

I further provide that the slags from which the tapping stream should be free are those which are high in oxides such as iron oxide, manganese oxide and silica.

I further provide a method whereby the inert gases which provide the stirring action are released as fine bubbles from a porous plug installed in the bottom of the ladle in such a position the gases flow into the tube suspended from the top of the ladle. The surface area of fine bubbles of gas from the porous plug provides enhanced hydrogen removal because there is more bubble surface area through which the hydrogen in the steel can diffuse into the bubbles.

I further provide a method whereby the inert gas may be introduced to the bottom of the large tube suspended in the ladle by means of a small pipe or pipes which are connected at their top to a source of inert gas and these small pipes are attached to the inside of the large tube. The thickness of the metal in the smaller pipes should be less than the thickness of the large tube so that the small pipes will melt faster than the large tube so that the gases are always released inside the larger tube.

I further provide that the slags used for desulfurization shall be lime based and their composition limits shall be: CaO 75% maximum, $Al_2O_3$ 30% maximum and $CaF_2$ 15% minimum. The melting points of the slags that fall within these composition limits may be determined from the ternary phase diagram for the CaO-$Al_2O_3$-$CaF_2$ system which is shown in FIG. 1.

I further provide that the maximum impurity levels of the slags of this invention shall be: FeO 3%, MnO 3% and $SiO_2$ 15%.

I further provide that the melting point of the slags of this invention and their viscosity may be further lowered by the additions of fluxes which are known to have an ability to lower the melting points of slags and lower their viscosity. Such fluxes include materials such as calcium chloride, cryolite, and lithium fluoride, lithium oxide and the like, but generally such fluxes are mainly some form of halogen salts.

I further provide that the slags necessary for desulfurization should be prefused prior to their use to minimize the amount of moisture that could be in such slags due to the hydroscopic nature of the components particularly the lime (CaO).

I further provide that when the oxygen level of the steel contained within the tube becomes low enough, phosphorus removal from the steel to the slag in the tube can occur. The oxygen level of the steel in the steel in the tube may be reduced to sufficiently low levels to achieve phosphorus removal by the action of the lime based slags of this invention and the addition of strongly deoxidizing metals and ferro-alloys which have been added down the tube.

I further provide that the quantity of inert gas used for stirring shall be equivalent to that used with other ladle refining technologies. However, since the stirring energy of the gas will be confined within the tube, the intensity of the stirring will be greater. With this increased intensity of stirring, sulfur removal will be faster and to lower levels, and hydrogen removal will be achieved. Since the tube extends to the top of the ladle and may be extended above the top of the ladle, the possibility of any splashing out the top of the tube is remote. In addition the energy of the stream entering the tube would provide a downward energy component which would help prevent any metal and slag from escaping from the top of the tube. The downward component of energy resulting from the stream of steel entering the tube should provide stirring energy in addition to that supplied by the release of gases from the bottom of the tube.

I further provide that in cases where the quantity of inert gas used is insufficient to reduce the hydrogen content of the steel significantly that the ability to conduct the desulfurization reaction within the tube through which the inert gas is constantly flowing will prevent the absorption of hydrogen and nitrogen which would ordinarily occur if desulfurization were conducted in such a manner that steel was exposed to the air during desulfurization. The absorption of hydrogen and nitrogen increases rapidly as the oxygen and sulfur contents of the steel are reduced. In other ladle refining technologies desulfurization may be conducted without any cover over the ladle, and even when there is a cover, it is often less than air tight.

I further provide that the rate of desulfurization may be increased and the sulfur content of the steel being treated can be further reduced when the steel coming into the tube is atomized by a stream of inert gas because it has been shown that reactions between droplets of metals and slag is more efficient than between a pool of metal and slag or a large stream of steel and slags.

I further provide that the top of the tube in the ladle can be enclosed and a device installed on the top of the tube of a design known to those skilled in the art to make an air tight seal between the bottom of the vessel which is the source of the steel going into the tube. When steel starts to flow into the tube, a vacuum can be created in the tube which will cause the stream of metal entering the tube to be atomized. Removal of hydrogen from atomized streams of metal is the most effective method of hydrogen removal, and the atomized droplets going into the tube would increase the rate and thoroughness of the desulfurizing reaction.

I further provide a method whereby ferro-alloys and metals of all kinds can be added into the tube in lump form. Adding the alloys in lumps has the advantage of reducing the amount of hydrogen introduced into the steel from the addition of the alloys compared to injection technology which utilizes fine particles because there is moisture occluded to the alloys and the larger the surface area of the fine particles necessary for injection technology provides an increased opportunity for moisture to be occluded to the particles and this moisture is a significant source of hydrogen.

I further provide a method whereby additional heat may be added to the steel in the ladle which was filled from the steel making furnace at an arc reheating station, known to those skilled in the art, prior to teeming the steel down the tube installed in the second ladle when necessary to achieve the desired pouring temperature for the steel into ingots, castings or into a continuous casting machine.

I further provide a method whereby heat may be added to the steel coming into the tube through the installation of electrodes or plasma guns in a horizontal plane in the top of the tube so connected to an electrical supply that all of the steel flowing into the tube would have to pass through the plane of the electrodes or plasma gun arcs.

I further provide a method whereby heat may be added to the steel after the ladle into which the tube was installed has been filled by removing the remaining portion of the tube from the ladle and taking the ladle to an arc reheating station which would be familiar to those skilled in the art.

As an example of the utilization of the teachings of this invention in simple form, a tube of steel about four feet in diameter, about one fourth inch in thickness is installed in a ladle directly over a porous plug installed in the bottom of the ladle. The tube is installed in the ladle in a manner which holds the top of the tube firmly in place and a provision is also made so that the portion of the tube that is not consumed during the process may be withdrawn after the ladle is full. The methods of installation should be apparent to any one skilled in the art. The tube may extend three or four feet above the top of the ladle to prevent any splashing of the steel out of the tube during the stirring action. The tube will extend to the bottom of the ladle. A heat of steel is tapped from a furnace into a ladle. Aluminum is added to the steel during the tap or added into the furnace prior to the tap as a means of providing steel with an oxygen content low enough to meet the requirements of the process. The desired aluminum content of the steel in the first ladle is in the range of 0.04/0.06%. The slag on the ladle full of steel tapped from the furnace may contain iron oxide, manganese oxide and silica in excess of 10% of each. This ladle full of steel from the furnace is brought over the second ladle and centered over the tube installed in the second ladle. When the nozzle in the first ladle is opened a stream of steel is introduced into the tube. Simultaneous to the opening of the nozzle in the first ladle, additions of the slag, ferro-alloys and metals are added into the tube. In some cases it may be desirable to have some of the prefused slag in the bottom of the tube. Also, simultaneously or prior to the opening of the nozzle in the first ladle, argon gas would be released through the porous plug in the bottom of the ladle. The flow rate of argon would be from 10 to 30 standard cubic feet (scf) per minute which is the rate of argon flow generally used for such ladle desulfurizing treatments. Since this argon flow is confined within the tube installed in the ladle, the increase in stirring energy per unit of area would be proportional to the square of the diameter of the ladle divided by the square of the diameter of the tube. If the ladle was twelve feet in diameter and the tube was four feet in diameter the increase in stirring energy would be nine times greater than the stirring energy achieved by a similar gas flow rate in the entire ladle. The composition of a typical slag to be added down the tube could be 55% CaO, 40% $CaF_2$ and 10% $Al_2O_3$. Such a slag would have a sulfur capacity twenty times that of a slag of roughly equal parts of CaO and $Al_2O_3$ which is a composition commonly used for desulfurization with present technology. The melting point of the slag proposed would be between 1350 and 1400 C. Furthermore, it has been demonstrated that such slags not only are effective for sulfur removal, but they also desulfurize more quickly. To achieve desulfurization with a slag of equal parts of CaO and $Al_2O_3$ might require as much as ten times longer to achieve the same degree of desulfurization as compared to the slag recommended by the teachings of this invention. The slag to be added into the tube should be prefused because otherwise the CaO in the slag, which is very hydroscopic, could absorb moisture which could add undesirable hydrogen to the steel being desulfurized. As the steel rises in the tube a certain quantity of the slag added to the tube would be carried by the stream of steel entering the tube under the bottom of the tube forming a slag coating on the top of the steel in the ladle preventing any reoxidation of the steel from the air in the ladle. The argon comes out the porous plug in the bottom of the ladle in what is generally referred to as a plume which has been determined to be quite narrow, and this plume should be confined within the tube. As a result there should be little or no agitation of the slag or the steel in the ladle outside the tube. The amount of slag used would be about the same as is presently used for desulfurization of steel which is in the range of 10 to 25 pounds per ton. It may be found that because of the greater efficiency of desulfurization by the teachings of this invention that lesser amounts of slag will be needed. A further advantage of adding the slag into the tube will be that with the stirring energy provided by the stream of metal entering the tube and the stirring energy provided by the stream of gas entering the bottom of the tube from the porous plug, the fusion and homogenization of the slag should be almost instantaneous. The stirring energy from the argon gas and the stream of metal entering the tube from the ladle should be additive, and as a result, the stirring energy should be very intense. In addition, the downward component of the energy of the stream of steel entering the tube from the ladle may help prevent the metal in the tube from being splashed too high up the tube. Erosion of the ladle lining will be minimal and uniform from top to bottom of the ladle because the stirring action outside of the tube should be minimal although the slags proposed in the teachings of this invention are considered to be very erosive to ladle linings. The severe erosion at the slag line that occurs when using conventional desulfurization technology is concentrated at the slag line due to the protracted stirring and heating times necessary to achieve adequate desulurization. This erosion at the slag line may be a major factor in determining when the ladle must be relined. The size of the nozzle in the first ladle should be chosen so that the metal flow from the first ladle into the second ladle is slow enough to allow sufficient time for desulfurization and hydrogen removal. A rate of flow from a nozzle $2\frac{1}{2}$ to 3 inches in diameter should provide a flow rate which should empty a 200 ton ladle in ten minutes. This should be sufficient time to complete the necessary reactions. Sulfur removal should be to very low levels and the degree of hydrogen removal will depend on the amount of gas used. It has been determined that hydrogen removal to the 1.5 parts per million (ppm) level from a level of 3.0 ppm can be achieved in ladles with argon flow rates of 50 scf per ton. Because of the intensity of the stirring within the tube, the argon requirements for that degree of hydrogen removal may be less than 50 scf per ton. In addition to the slags being added down the tube, all manner of ferro-aloys and metals can be added with the slag. These alloys would not have to be finely divided as is the case when alloys are added with injection technology, but could be in the form of lumps which might be as large as six inches in their maximum dimension. The ferro-alloys and metals which benefit most from addition to steels according to the teachings of this invention are those which have high melting points and are difficult to get into solution and also those whose recoveries from their addition have been less than the amount added to the steel such as electrolytic manganese, ferro-niobium, ferro-tungsten and the like. The metals that may be added include aluminum, calcium, barium, rare earths and the like. The recovery of elements in the steel from additions of metals and ferro-alloys is reduced in many cases in conventional steel making technology by their contact with slags high in oxides such as iron oxide and the like which are known to be typical of the slags that would be found on the ladle into which the steel from the furnace was tapped. Since the slags found in the tube will contain little or no oxides of this type, the amount of the desired elements retained in the steel from additions of ferro-alloys and metals should be almost complete if the elements are soluble in steel and their vapor pressures at the temperature at which they are added to the steel are low.

As a further example of the teachings of this invention with respect to attaining minimum hydrogen contents in the steel, it has been determined that the final hydrogen content of steel is related to the amount in the steel when it is tapped from the melting furnace, the amount that was added to the steel during ladle refining and desulfurization and the amount removed by vacuum degassing or argon bubbling. Hydrogen is added to steel during conventional ladle refining in several ways. First, many conventional ladle refining techniques use injection techniques for the addition of slags, metals and ferro-alloys. All of the materials used in injection techniques have to be ground to very fine sizes. When ferro-alloys are ground to these small sizes their moisture content can increase because the amount of moisture that can be occluded on the ferro-alloys increases as the surface area increase and the surface area of finely ground alloys is large. In addition, many ferro-alloys are produced in furnaces where the slags may contain calcium carbide. Some of this calcium carbide is entrapped in the ferro-alloys and when the finely divided ferro-alloys are exposed to moisture, the calcium carbide and the moisture react with the formation of acetylene and calcium compounds high in hydrogen. A similar situation occurs with respect to the slags which are to be injected. Because of their large surface area they have an ability to occlude moisture and because they are generally high in lime, which is very hydroscopic, their moisture content can be a significant source of hydrogen in the steel to which they are added. Second, it is known that both hydrogen and nitrogen are more readily absorbed by steel when the oxygen and sulfur contents are low. The sulfur contents of steel are low at the slag metal interface where desulfurization takes place. If there is not a tight cover over the ladle during desulfurization, moisture from the air and nitrogen can be introduced into the steel at this time. In contrast, according to the teaching of this invention, the slag, ferro-alloys and metals added with this technology can be in lump form which means that their surface area could be several orders of magnitude less than the surface area of similar materials added with injection technology. In addition, the desulfurizing reactions occur at the bottom of the tube suspended in the ladle, and there is a constant flow of inert gas up this tube which excludes air from the site of desulfurization thus eliminating one of the major sources of hydrogen pickup during ladle refining. Therefore, the hydrogen content of steel made utilizing the teachings of this invention should be minimal because: the technology provides for the elimination of hydrogen by argon bubbling through the steel, the process can use lumps of slag, ferro-alloys and metals which means that the surface area, which can occlude moisture will be small compared to the surface area of similar material sized for injection techniques. Finally, an inert atmosphere is maintained at the site of desulfurization by the flow of inert gas up the tube. Since the steel in the ladle is covered by a blanket of slag as the ladle is filled and because the stirring action from the use of inert gas is confined within the tube, there is little opportunity for the steel in the ladle outside the tube to absorb any hydrogen. As a result, the hydrogen content of steel made with the technology of this invention should be low enough to meet very demanding requirements for low hydrogen.

As a further example of the teachings of this invention, it would be possible that sufficient temperature could be added to the steel prior to tapping that no additional temperature would have to be added after the completion of desulfurization and degassing. However, if the additional temperature necessary to carry out the teachings of this invention presents a hardship with respect to reduction of the life of furnace linings, additional temperature may be added according to the teaching of this invention which would utilize electrodes or plasma guns installed in the top of the tube through which the stream of steel would pass whereby the steel could be heated. With respect to attaining the proper temperature in the steel necessary to cast the steel into ingots, castings or into a continuous casting machine, temperature may be added either prior to the teeming of the steel down the tube or after the teeming of the steel into the tube is completed at an arc reheating station, which is a type of equipment available for heating steel in ladles known to those skilled in the art.

The teachings of this invention do not specify the type of refractories that should be used in the ladle in which the tube is installed. Since the desulfurization will be conducted in the tube which will have a coating of the slags of the invention on it, the ladle refractory will have little influence on the extent of desulfurization. However, if it is desired to obtain and keep the minimum oxygen content in steels manufactured with the teachings of this invention, the ladles in which the tube is to be installed should be lined with stable refractories. It is known that when steel is in contact with unstable refractories such as firebrick or alumina of low purity, that the steel can absorb a significant amount of oxygen from such bricks. Therefore, if the minimum oxygen content of the steel is to be maintained, the more stable the lining of the ladle the better. Magnesia linings or high alumina linings would be preferred.

As an example of the utilization of the further teachings of this invention, the techniques used in the example above may be modified to the extent that the inert gas supply for stirring may be introduced into the bottom of the large tube from a smaller pipe or pipes of lesser thickness than the main tube. Because these pipes are of a lesser thickness, they will melt more rapidly than the larger tube. Their thickness would be chosen so that there would be little or no flow of inert gas from beneath the main tube and thick enough that the inert gas supply would be contained well within the metal in the main tube. Otherwise, the teachings of the invention as previously described would prevail.

As an example of the utilization of the further teachings of this invention, the techniques used in the detailed illustration above may be modified to the extent that the stream of metal coming into the second ladle could be atomized by an inert gas with technology known to those skilled in the art. The fine droplets of steel entering the tube would have a surface area many times greater than that of a compact stream of metal thereby increasing the rate of reaction between slag and metal resulting in faster and more complete desulfurization. Otherwise, the teachings as described in detail above will prevail.

As an example of the utilization of the further teaching of this invention, the large tube to be inserted into the ladle could be modified in a manner known to those skilled in the art whereby a vacuum could be applied within the tube. When there was sufficient metal in the ladle so that vacuum could be applied within the tube without sucking air into the tube, the vacuum could be applied. When the vacuum was applied the stream of metal coming into the tube would be broken into little droplets from which it would be easier to eliminate hydrogen and the small droplets would increase the rate of desulfurization. A further modification would have to be made to the tube to allow the addition of the slag, ferro-alloys and metals under vacuum by methods known to those skilled in the art. Because the stirring energy with inert gases under vacuum may be an order of magnitude greater than under atmospheric pressure, the amount of inert gas required to achieve the necessary stirring would be reduced to as little as one tenth of that required when the teachings of the invention are practiced under atmospheric conditions. Otherwise, the teachings described in detail previously would prevail.

One of the common methods for desulfurizing steel with present technology is to add a slag of equal parts of CaO and $Al_2O_3$ into a ladle full on steel containing 0.04/0.06% aluminum. Stirring is achieved with a porous plug installed in the bottom of the ladle.

The concluding example describes the advantages of the teachings of this invention compared to conventional methods of desulfurization in more specific terms.

In the foregoing general description of this invention I have set out certain objects, purposes and advantages of this invention. Other objects, purposes and advantages of this invention will be apparent from a consideration of the following description and the accompanying drawings in which.

Figure 1:
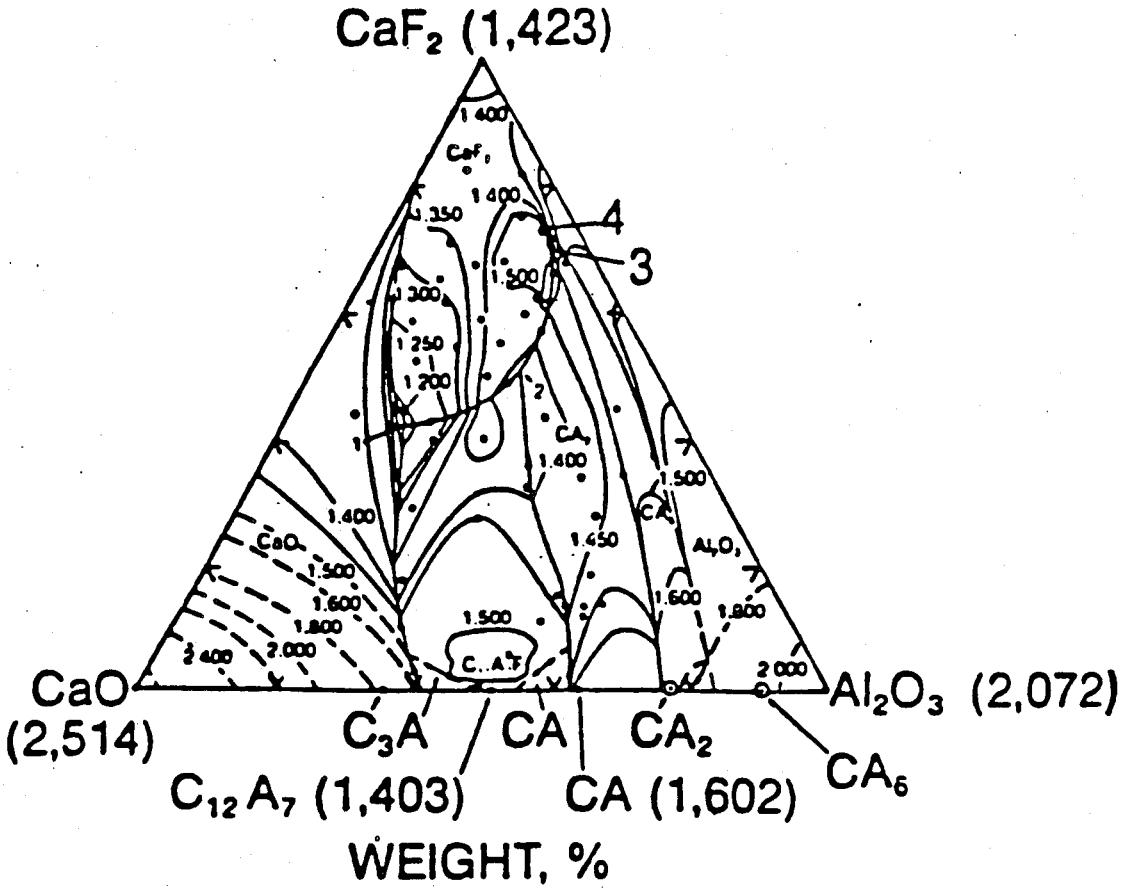
FIG. 1 is a diagram of liquidus isotherms of slags of lime, alumina, and fluorspar.
Figure 2:
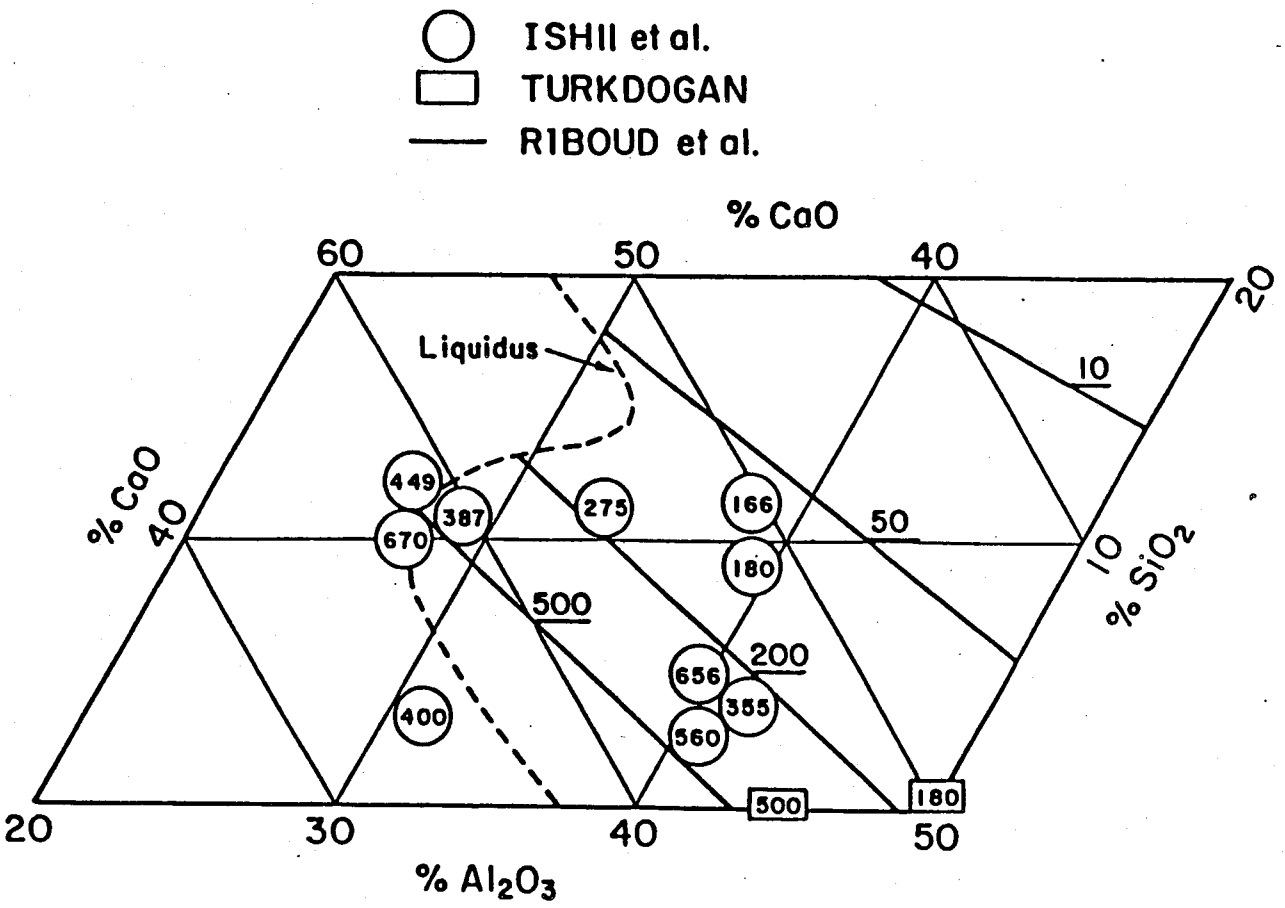
FIG. 2 is a portion of the $CaO$-$Al_2O_3$-$SiO_2$.
Figure 3:
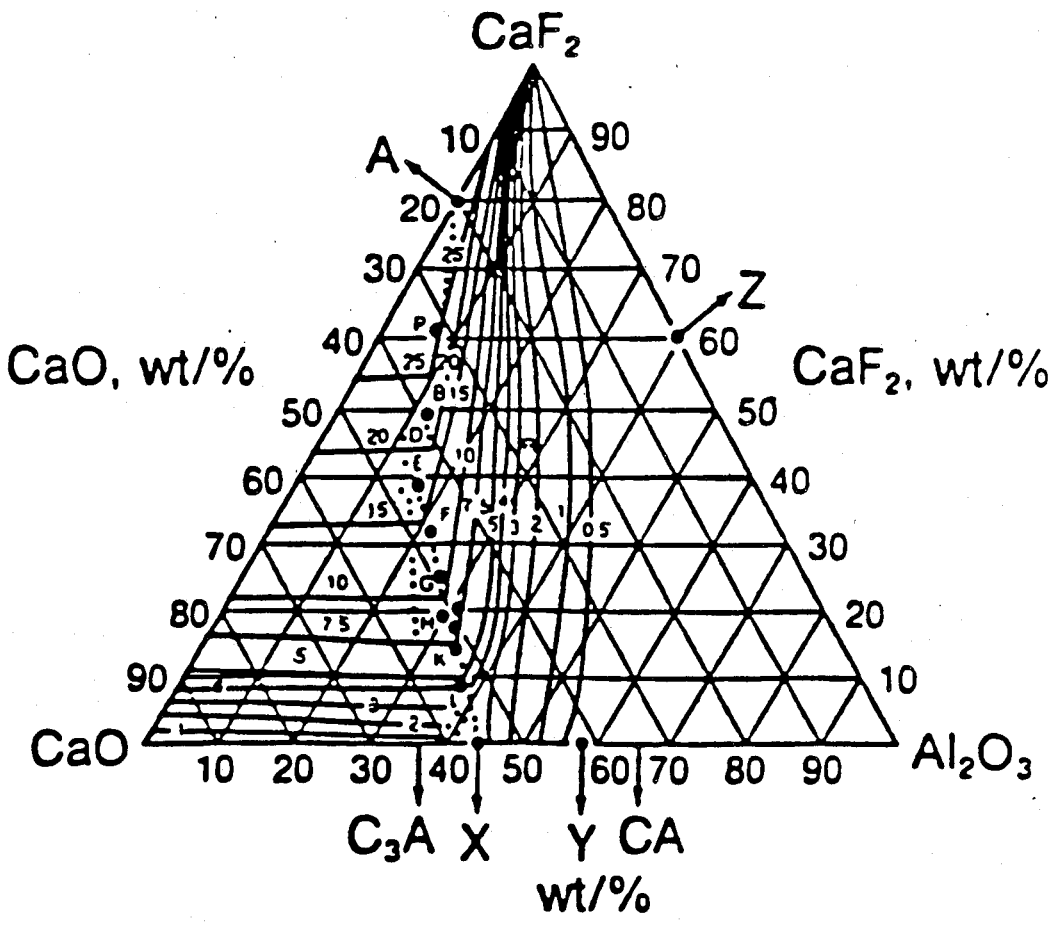
FIG. 3 is a diagram of sulfur capacities of slags.
Figure 4:
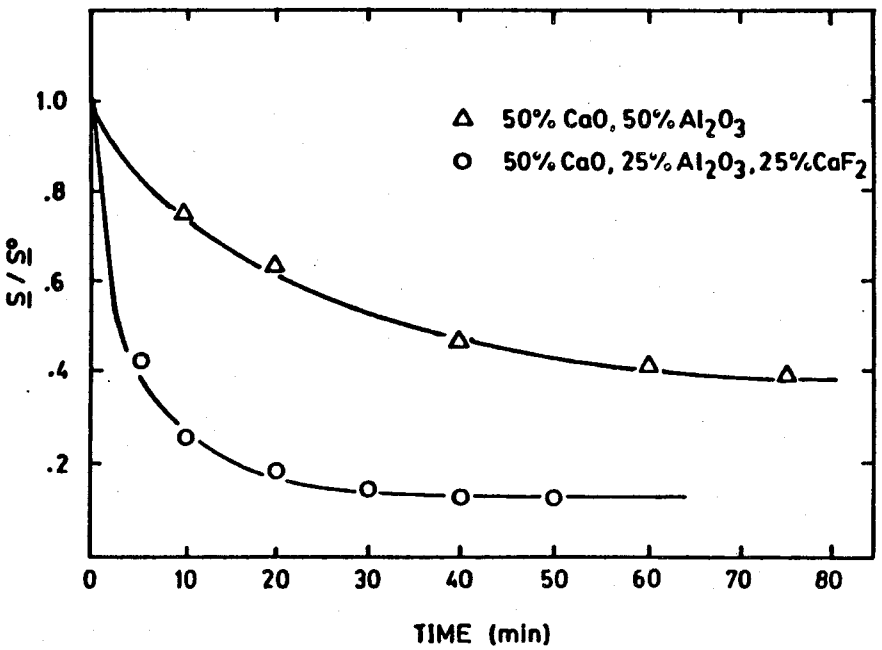
FIG. 4 is a diagram of desulfurization of 18-8 stainless steel in an induction furnace.

The most common method of describing the desulfurizing capabilities of slags is on the basis of the sulfur distribution ratio betwen the sulfur in the steel and the sulfur in the slag. FIG. 2 shows a portion of the $CaO$-$Al_2O_3$-$SiO_2$ ternary diagram, and the bottom line of this diagram is a portion of the binary diagram for CaO and $Al_2O_3$. With a mixture of 50% CaO and 50% $Al_2O_3$ the sulfur distribution ratio is given as 180 at 1600 C. FIG. 3 shows the sulfur capacities of slags from the $CaO$-$Al_2O_3$-$CaF_2$ diagram as compared to the sulfur capacity of CaO at 1500 C. The slags used with the teachings of this invention, within the composition limits stated above, have sulfur capacities many times greater than CaO. A slag of equal parts of CaO and $Al_2O_3$ has a sulfur capacity equal to that of CaO alone or a sulfur capacity of one. In FIG. 2 a slag of that composition was shown to have a sulfur distribution ratio of 180. A recent study done at a Canadian university compared the desulfurization capability of a slag with equal parts of CaO and $Al_2O_3$ and a slag with 50% CaO, 25% $Al_2O_3$ and 25% $CaF_2$. The data in FIG. 3 indicates such a slag should have a sulfur distribution ratio twelve times greater than CaO or a slag with equal parts of CaO and $Al_2O_3$. FIG. 2 showed that a slag with equal parts of CaO and $Al_2O_3$ had a sulfur distribution ratio of 180, therefore a slag which is twelve times as effective as CaO or equal parts of CaO and $Al_2O_3$ should have a sulfur distribution ratio $12\times180$ or 2160. FIG. 4, from the Canadian university's work confirms the vast superiority of a slag with 50% CaO, 25% $Al_2O_3$ and 25% $CaF_2$ as a desulfurizer compared to a slag with equal parts of CaO and $Al_2O_3$.

Figure 5:
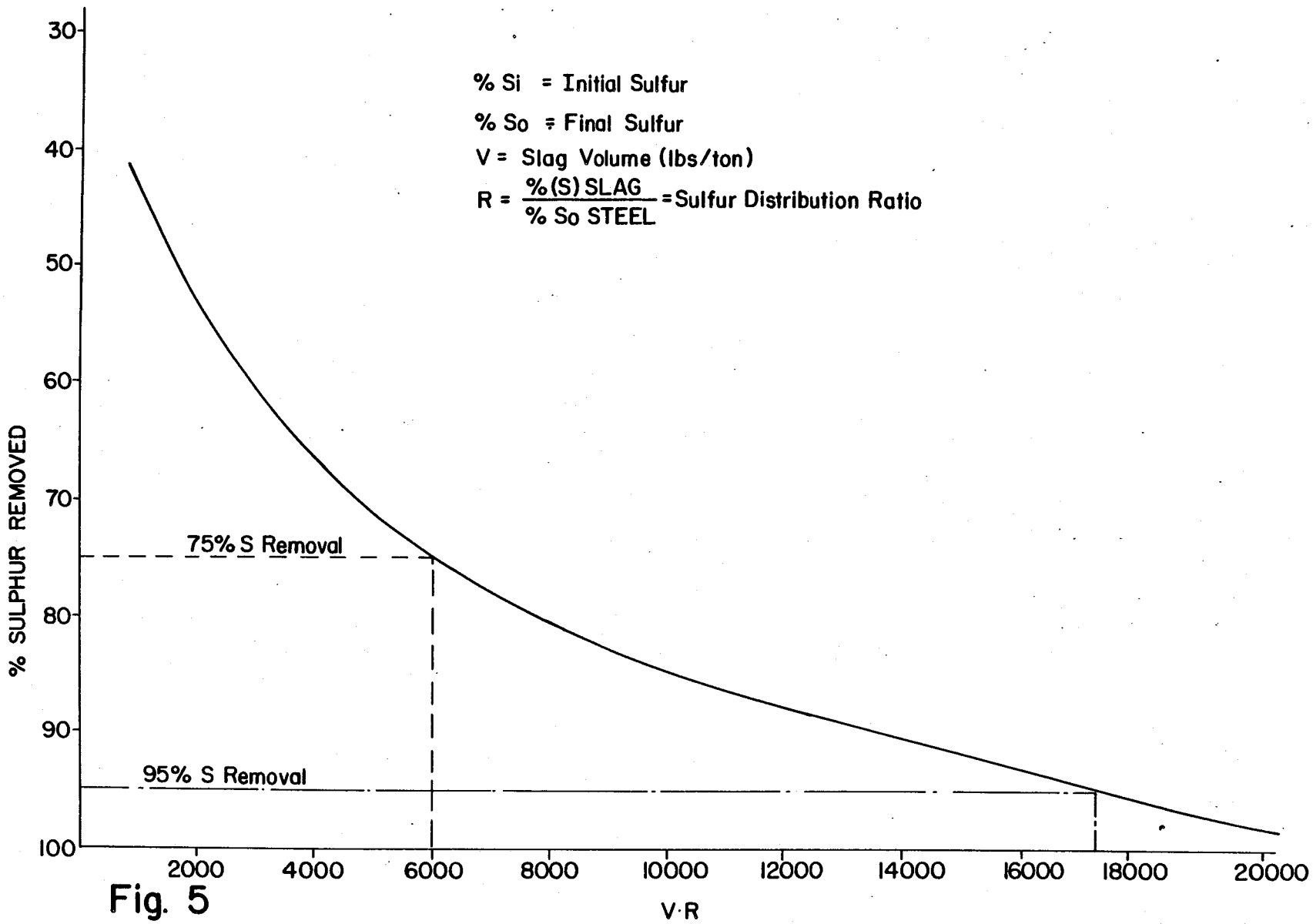
FIG. 5 is a diagram of sulfur removal to slag volume and sulfur distribution.
Figure 6:
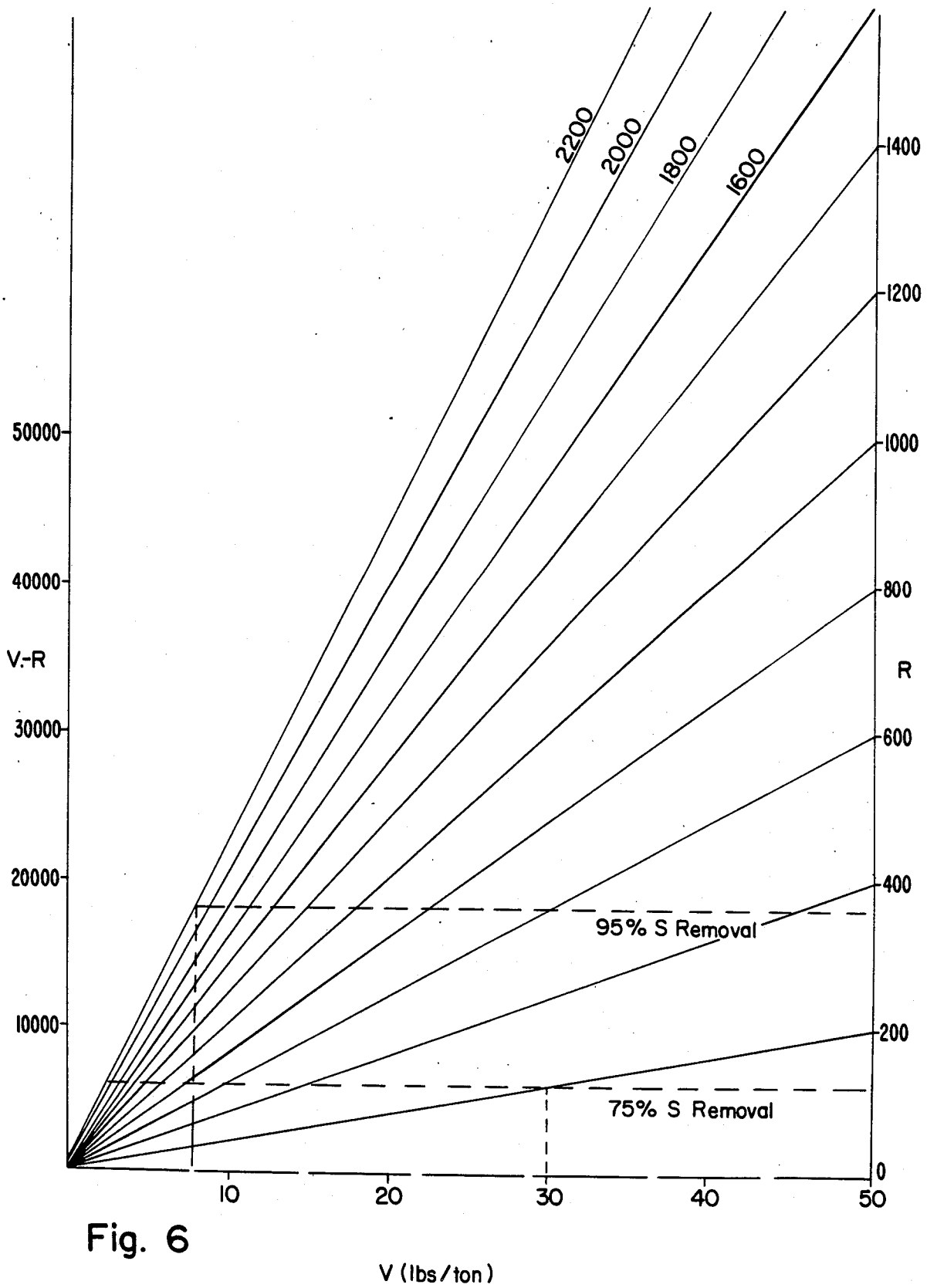
FIG. 6 is a diagram of slag volume and sulfur distribution to slag volume.

A simple model for determining the amount of slag necessary to achieve any degree of desulfurization as a function of sulfur distribution ratio and slag volume has been developed. The model is in two parts and the first part, FIG. 5, shows that the degree of desulfurization required can be predicted by multiplying the sulfur distribution ratio (R) by the volume of slag being used per ton (V). Two examples are indicated on FIG. 5: one for 75% sulfur removal and the other for 95% sulfur removal. For 75% sulfur removal, VR is equal to 6000 and for 95% sulfur removal VR is equal to 17500. The second part of the model is shown in FIG. 6 where the VR is related to V (pounds of slag to be added for each ton of steel being desulfurized) which in turn is related to each of the sulfur distribution ratios (R) indicated on the vertical axis on the right side of FIG. 6 or on the lines representing various sulfur distribution ratios. For 75% sulfur removal (from 0.025% to 0.0063%) with a VR as determined from FIG. 5, with an R value of 200 it will require 30 pounds per ton of slag to achieve the desired sulfur content in the steel whereas with an R value of 2200 it will only require about 3 pounds per ton of slag. The difference is more striking when it is necessary to remove 95% of the sulfur (from 0.025% to 0.0013% which corresponds to a VR of 17500) which requires about 9 pounds of slag with an R value of 2200 and as much as 100 pounds of slag with an R value of 200. This model clearly demonstrates the importance of the sulfur distribution ratio with respect to the amount of slag necessary for sulfur removal because smaller amounts of slag result in lower cost because of the smaller slag volumes required and the reduction of superheat in the steel necessary to melt the slag.

The rate of desulfurization is measured by the mass transfer coefficient ($m_s$) for the desulfurization reaction. The mass transfer coefficient is a function of:

1. The amount of stirring which is controlled by the quantity of gas being used for stirring;
2. The area of the slag-metal interface being stirred;
3. The sulfur distribution ratio of the slag being used for desulfurization.

In the paper which contained FIG. 2, an example was cited with the following conditions for desulfurization:

1. A ladle with a diameter of 12.35 feet was used;
2. Argon was released from the porous plug into the bottom of the ladle at a rate of 15 standard cubic feet per minute (SCFM).

With this ladle size and argon flow rate, the mass transfer coefficient was calculated to be 0.10. The paper stated that the mass transfer coefficient is related to the amount of surface being stirred. If the surface is contained within a four foot diameter tube suggested according to the teaching of this invention, the mass transfer coefficient should be inversely related to the squares of 12.35 and 4 which would give a ratio of 9. Since the mass transfer coefficient for the 12.35 foot diameter ladle was 0.10, nine times that would give a mass transfer coefficient of 0.90 within the four foot diameter tube.

Figure 7:
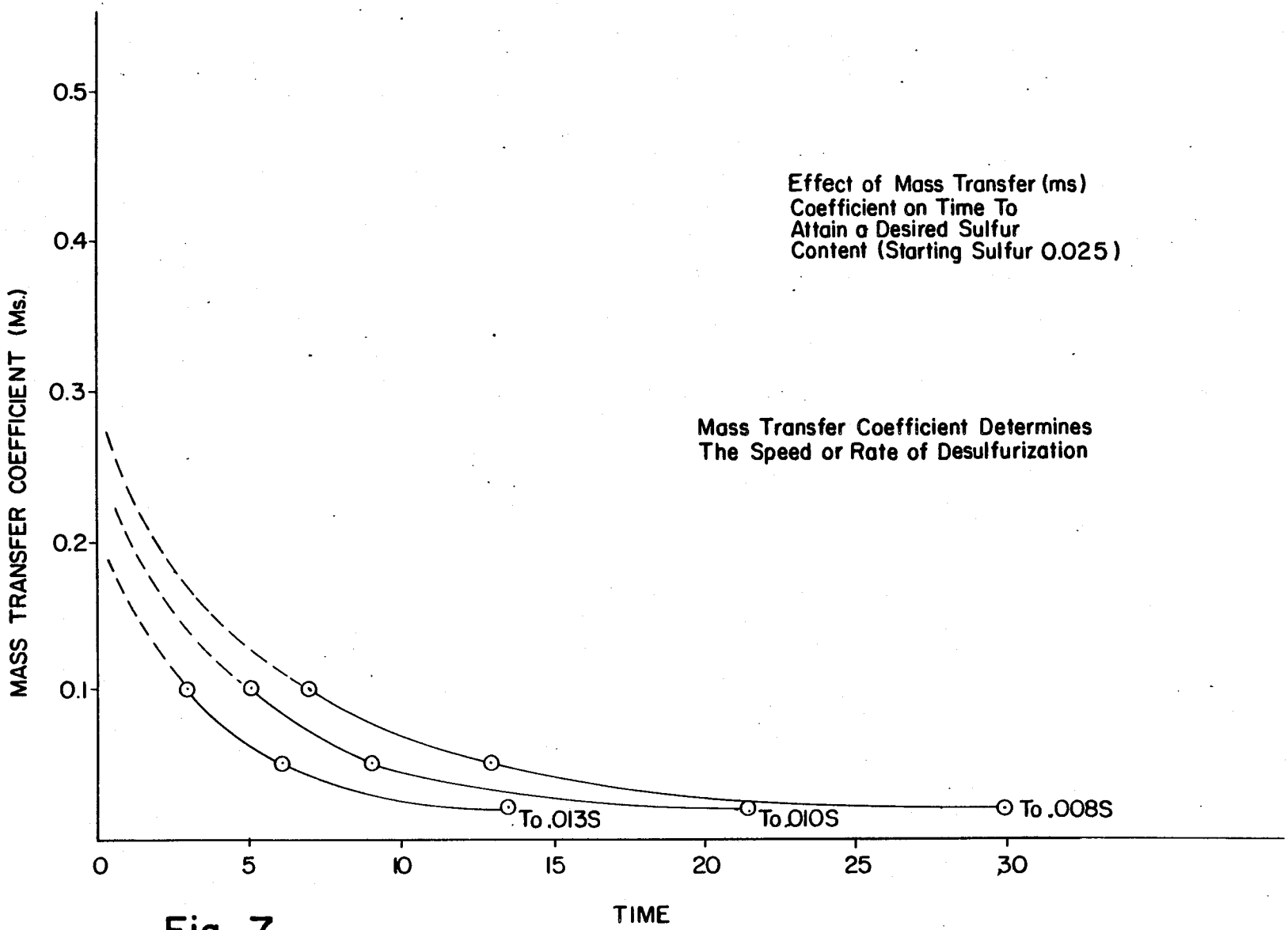
FIG. 7 is a diagram of mass transfer coefficient to time.

The data in FIG. 3 from the paper describing the effect of mass transfer coefficient has been replotted to show the effect of the mass transfer coefficient on the time necesary to attain a desired sulfur level in the steel. The replot of the data is presented in FIG. 7 which shows that the time necessary to achieve any given sulfur level in the steel is controlled by the mass transfer coefficient. More important, FIG. 7 shows that with a mass transfer coefficient greater than about 0.30, that the time necessary to achieve the desired degree of desulfurization is short. The time necessary to achieve the desired degree of desulfurization with the teachings of this invention is of the utmost importance because the residence time of the steel in the tube is short. If the portion of the tube that remains intact as the ladle fills contains ten tons and the rate of teeming from the first ladle into the second ladle is ten tons per minute, the average residence time of the steel in the tube is one minute. The data in FIG. 7 indicate this would be sufficient time to achieve desulfurization to any level if the mass transfer coefficient is close to 0.90. As mentioned previously, the mass transfer coefficient is also influenced by the sulfur distribution ratio of the slag. The high sulfur distribution ratios of the slags proposed by the teachings of this invention could make the high mass transfer coefficient projected for the technology of this invention more likely.

The rapid desulfurization to low levels achieved at the Canadian university with a slag containing 50% CaO, 25% $Al_2O_3$ and 25% $CaF_2$ was with induction stirring only. The mass transfer coefficient for induction stirring has been computed to be 0.02. With the mass transfer coefficient expected based on the teachings of this invention (0.90) desulfurization with a slag like that used at the Canadian university would be to much lower sulfur levels in a much shorter time.

The teachings of this invention with regard to the gas content of steels are based on three concepts:

1. Oxygen removal is achieved with slags proposed by the teachings of the invention and stirring;
2. Hydrogen and nitrogen removal is achieved by bubbling argon through the steel;
3. Hydrogen and nitrogen absorption from the air, encountered with conventional ladle metallurgy technology where there is no cover over the steel during desulfurization or if the cover used does not prevent air from coming in contact with the steel being desulfurized, is prevented.

Figure 8:
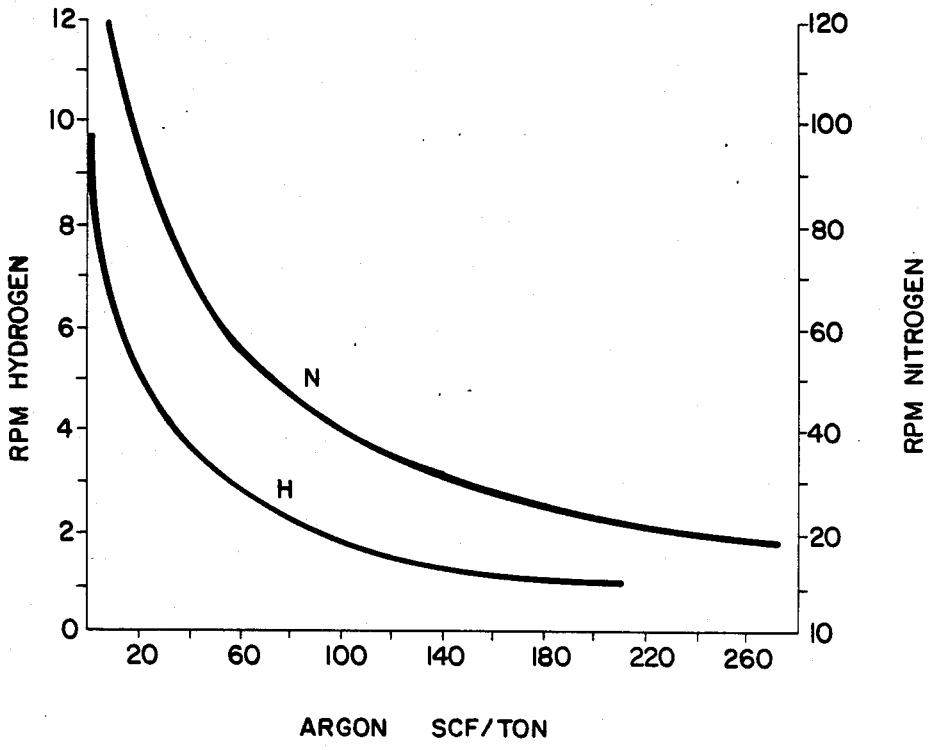
FIG. 8 is a diagram of hydrogen removal with argon bubbling.
Figure 9:
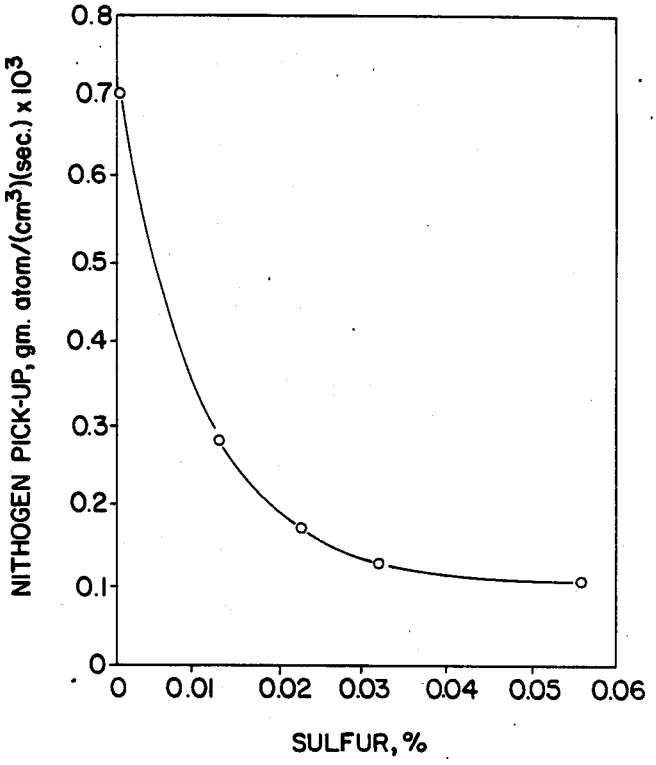
FIG. 9 is a diagram of nitrogen absorption as a function of sulfur content.

The extent of hydrogen and nitrogen removal with argon bubbling in ladles is shown in FIG. 8. The very high flow rates necessary to achieve low hydrogen and nitrogen levels were required when the argon for degassing was introduced into the ladle of steel from a single tuyere in the side of the ladle. Hydrogen and nitrogen removal according to the teachings of this invention should have several advantages over this older technology:

1. The argon would be released from a porous plug rather than from a tuyere so that the surface area of the bubbles passing through the steel would be greater;
2. By confining the argon bubbling within the tube, it would be expected that the mass transfer coefficient for hydrogen and nitrogen from the steel into the bubbles of argon would be increased in a manner similar to the increase in mass transfer coefficient for the desulfurization reaction;
3. The atmosphere over the slag metal interface in the tube should be essentially pure argon which would prevent hydrogen and nitrogen being absorbed back into the steel as could be the case with conventional ladle desulfurizing or degassing practices particularly if the ladle cover is not tight. The extent of nitrogen absorption by steel as a function of its sulfur content is shown in FIG. 9. It has been determined that hydrogen is similarly absorbed when the sulfur content of the steel is low.

Figure 10:
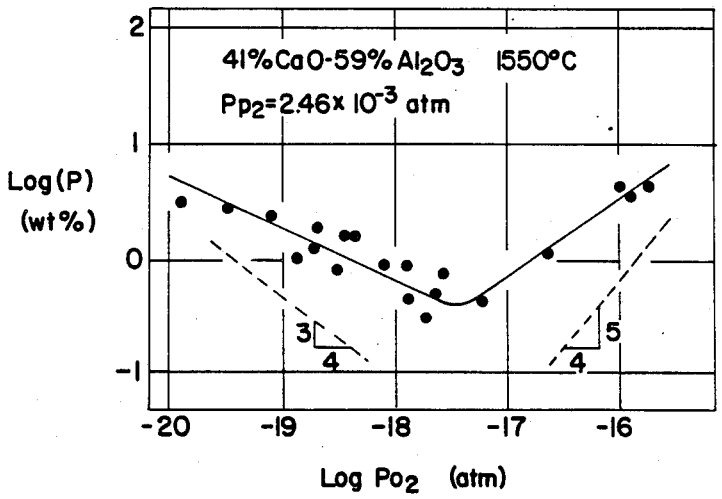
FIG. 10 is a diagram showing the relation of phosphorus and oxide.
Figure 12:
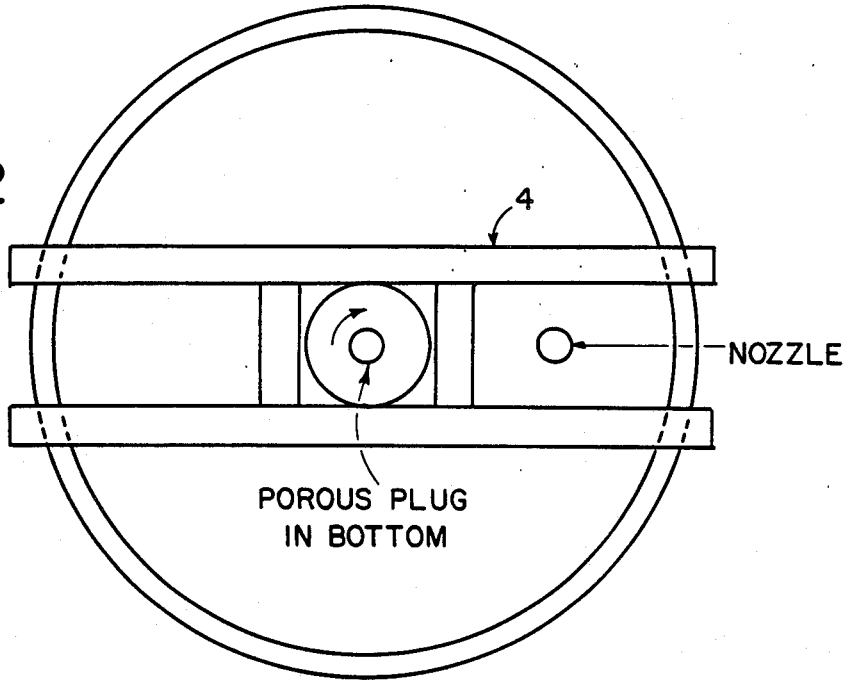
FIG. 12 is a top plan view of the ladle of FIG. 11.

A recent review of dephosphorization showed that it was possible to remove phosphorus from steel with reducing slags according to the teachings of this invention as well as with oxidizing slags. FIG. 10 indicates that the phosphorus content of slags can increase when the slags are either highly oxidizing or reducing. The slags and the oxygen removal from the steel achieved with the teachings of this invention should permit the removal of phosphorus from steels made according to the teachings of this invention.

Figure 11:
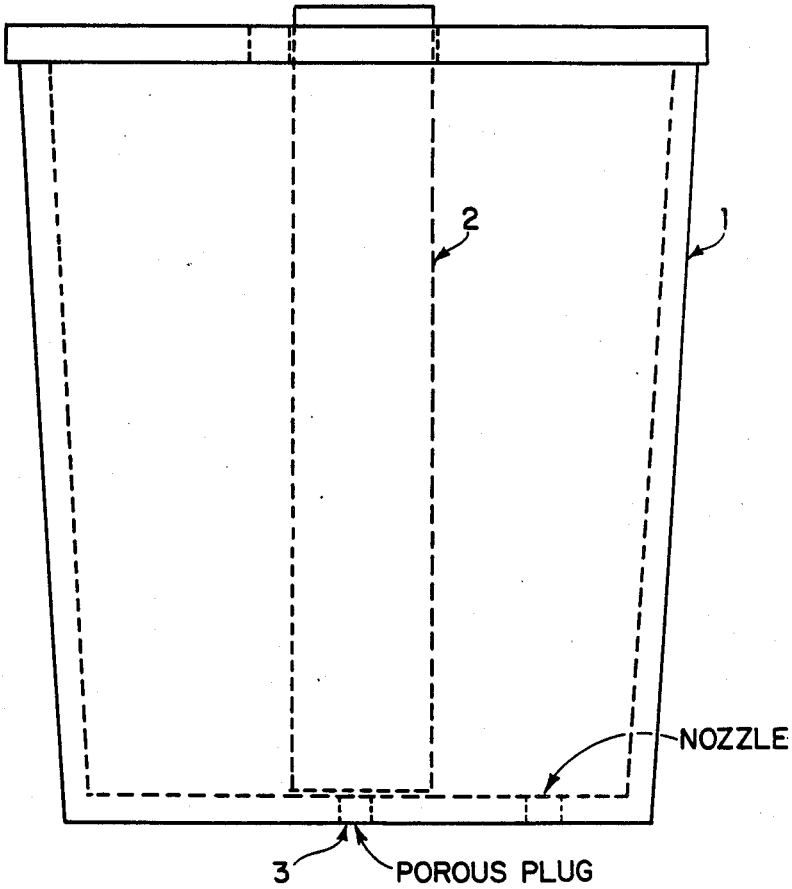
FIG. 11 is a side elevation of a ladle used in the process of the present invention.

FIG. 11 is a drawing illustrating the machanics of the above-described process in which I provide a ladle 10 into which the steel is to be introduced. The ladle is provided with a steel tube 11 inserted axially in the vertical direction in the ladle. A porous plug 12 is provided in the bottom of the ladle. The tube 11 is held in place by means of a framework of steel bars 13 at the top of the ladle. A discharge nozzle 14 is provided off center in the bottom of the ladle. In operation, the gas coming from the porous plug 12 rises essentially vertically up the plug toward the surface of the steel through the tube 11. Water models of such a ladle arrangement have shown that the gas coming from the porous plug proceeds vertically in a narrow plume which rises essentially straight up from the plug toward the surface of the liquid in the ladle. In a ladle that is nine feet deep the diameter of the plume at the surface will be less than four feet in diameter. The steel tube 11 dissolves in the steel but the rate at which it dissolves is slower than the rate of rise of the steel in the ladle therefore the portion of tube remaining submerged in the steel to which the inert gas travels from the porous plug 12 to the surface of the steel in the ladle become in effect a small reaction vessel which is stirred much more vigorously than can be achieved with any method involving the stirring of the ladle full of steel because the stirring action is combined within that small volume of metal in the portion of the tube that extends below the surface of the metal in the ladle. A specific description of the stirring action is described above.

In the foregoing specification I have set out certain preferred practices and embodiments of my invention, however, it will be understood that this invention may be otherwise practiced within the scope of the following claims.

I claim:

1. The method for removing sulfur and hydrogen from steel comprising the steps of:

(a) pouring a stream of steel, low in oxygen and free of slag into a vertical tube installed in a ladle which extends from the bottom of the ladle to the top of the ladle, (b) providing a means to introduce a flow of inert gas into the bottom of the tube to provide a stirring action within the tube, (c) adding a lime based slag with a large capacity to absorb sulfur into the tube;

(d) adding ferro-alloys and elemental metals into the tube which are known to enhance desulfurization and are necessary to achieve the specificed composition of the steel;

(e) utilizing the stream of inert gas introduced into the bottom of the tube as a means for hydrogen removal.

2. The method as claimed in claim 1 wherein the desired stream of steel low in oxygen and free of slag going into the tube may be achieved by teeming the steel through the nozzle in the bottom of the ladle into which the steel was tapped from the steel making furnace.

3. The method as claimed in claim 1 wherein the desired stream of steel low in oxygen and free of slag going into the tube may be achieved by adding elements known to have a strong affinity for oxygen such as aluminum, silicon, calcium, rare earths, titanium, zirconium and the like either into the steel making furnace prior to tap or into the ladle which received the steel from the furnace.

4. The method as claimed in claim 1 wherein the desired stream of steel low in oxygen and free of slag is achieved by adding elements known to have a strong affinity for oxygen, such as aluminum, silicon, calcium, rare earths, titanium, zirconium and the like into a steel making furnace equipped with a means for eccentric tapping, bottom tapping or any other means known to those skilled in the art for obtaining a stream of steel low in oxygen and free of slag.

5. The method for removing sulfur and hydrogen from steel comprising the steps of:

(a) pouring a stream of steel high in oxygen but free of slag into a vertical tube installed in a ladle which extends from the bottom of the ladle to the top of the ladle;

(b) providing a means to introduce a flow of inert gas into the bottom of the tube to provide a stirring action within the tube;

(c) adding a lime based slag with a large capacity to absorb sulfur into the tube;

(d) adding ferro-alloys and elemental metals into the tube which are known to enhance desulfurization and are necessary to achieve the specified composition of the steel;

(e) utilizing the stream of inert gas introduced into the bottom of the tube as means for hydrogen removal.

6. The method as claimed in claims 1 or 5 wherein the metals being added that are known to have a strong affinity for oxygen may be combined with other metals or metalloids such as iron, silicon and carbon; such combinations are generically referred to as ferro-alloys.

7. The method as claimed in claims 1 or 5 wherein the slags from which the steam of metal going into the tube must be free are those in which the content of both iron oxide and manganese oxides combined is greater than 6%.

8. The method as claimed in claims 1 or 5 wherein the tube extending from the top to the bottom of the ladle is of a composition compatible with the composition of the steel entering the ladle through the tube.

9. The method as claimed in claims 1 or 5 wherein the tube extending from the top to the bottom of the ladle is made of steel whose composition is compatible with the composition of the steel being poured through the tube.

10. The method as claimed in claims 1 or 5 wherein the tube is extended above the top of the ladle so that vigorous stirring may be achieved while the ladle is being completely filled.

11. The method as claimed in claims 1 or 5 wherein the inert gas which provides the stirring action is obtained through a porous plug installed in the bottom of the ladle in such a position that the tube can be positioned over the porous plug.

12. The method as claimed in claims 1 or 5 wherein the inert gas which provides the stirring action in the tube is obtained from a small pipe or pipes whose diameter is only a small fraction of the diameter of the tube installed in the ladle and whose walls are thinner than the wall of the large tube which extends from the top to the bottom of the ladle, and said small pipes to be connected to a source of inert gas.

13. The method as claimed in claims 1 or 5 wherein the amount of inert gas being used for stirring is supplied at a rate of 10 to 30 standard cubic feet per minute (SCFM) which is equivalent to that used with other ladle refining technologies.

14. The method as claimed in claims 1 or 5 wherein the slags used for desulfurization shall be lime based and their composition limits shall be: calcium oxide (CaO) 75% maximum, alumina ($Al_2O_3$) 30% maximum and calcium flouride ($CaF_2$) 15% minimum.

15. The method as claimed in claims 1 or 5 wherein the slags used for desulfurization shall contain a maximum of 3% iron oxide, 3% manganese oxide and 15% maximum silica.

16. The methods as claimed in claims 1 or 5 wherein the slags used for desulfurization may contain fluxes containing as one of their major constituents one of the salts of the halogens which would make the slags more fluid and more reactive such as calcium chloride ($CaCl_2$), cryolite ($Na_3AlF_6$), lithium fluoride (LiF), lithium chloride (LeCl) and the like.

17. The method as claimed in claims 1 or 5 wherein the inert gas used for stirring the slag and steel together to achieve desulfurization is also used as a means of scavenging hydrogen from the steel being poured through the tube.

18. The method as claimed in claims 1 or 5 wherein the inert gas being used for stirring the slag and steel together to achieve desulfurization provides an inert atmosphere in the tube free from moisture and hydrogen precluding the absorption of hydrogen by the steel going through the tube and at the desulfurization reaction site in the tube.

19. The method as claimed in claims 1 or 5 wherein the inert gas used is argon.

20. The method as claimed in claims 1 or 5 wherein the ferro-alloys and elemental metals to be added in the tube to enhance desulfurization are those whose ability to enhance the desulfurization relies mainly upon their ability to reduce the oxygen content of the steel which includes aluminum, titanium, zirconium and the like.

21. The method as claimed in claims 1 or 5 wherein the ferro-alloys and elemental metals to be added in the tube to enhance desulfurization are those which are known to have the ability to reduce the oxygen content of the steel, but also have the ability to form sulfides which would float out of the steel into the slag which include magnesium, calcium, barium, rare earths and the like.

22. The method as claimed in claims 1 or 5 wherein the ferro-alloys and elemental metals to be added in the tube are those necessary to obtain the desired chemical analysis of the finished steel such as ferro-niobium, ferro-molybdenum, ferro-tungsten, tungsten metal, ferro-chromium, ferro-manganese, manganese metal and the like.

23. The method as claimed in claims 13, 14 or 15 wherein the slags to be added into the tube have been prefused.

24. The method as claimed in claims 7 or 8 wherein the tube may be coated with a refractory coating which retards the rate at which the tube will go into solution in the steel.

25. The method as claimed in claims 1 or 5 wherein the steel free of slag entering the tube is atomized by a stream of inert gas at a position adjacent to the top of the tube inserted in the ladle.

26. The method as claimed in claims 1 or 5 wherein the top of the tube is enclosed and fitted with the necessary equipment to make an air-tight seal between the bottom of the ladle and the top of the tube so that a vacuum can be maintained in the tube during the filling of the second ladle.

27. The method as claimed in claims 1 or 5 wherein the top of the tube may be altered so that electrodes or plasma guns can be mounted in a horizontal plane and the steel entering the tube would pass through the plane of the arcs created between the electrodes or plasma guns thereby increasing the temperature of the steel.

28. The method as claimed in claims 1 or 5 wherein the portion of the tube remaining in the ladle is removed and the ladle transferred to an arc heating station whereby the temperature of the steel can be raised to the desired level.

29. The method as claimed in claims 1 or 2 wherein the temperature of the steel in the ladle into which the steel was tapped from the furnace may be increased by raising the temperature of the steel in an arc reheating station, known to those skilled in the art, prior to teeming the steel into the tube in the ladle where desulfurization and degassing occurs.

30. The method as claimed in claims 1 or 5 wherein the oxygen content of the metal and the slag in the tube has been reduced to such a low level that there is a transfer of phosphorus from the steel into the slag.

31. The method as claimed in claims 1 or 5 wherein the stream of inert gas introduced into the bottom of the vertical tube installed in the ladle as a means of removing hydrogen removes nitrogen from the steel also.

* * * * *